US008770829B1

(12) United States Patent
Howard

(10) Patent No.: US 8,770,829 B1
(45) Date of Patent: Jul. 8, 2014

(54) CLOCK CASE

(71) Applicant: Wolf Designs, Inc., West Los Angeles, CA (US)

(72) Inventor: Edward O. Howard, Albourne (GB)

(73) Assignee: Wolf Designs, Inc., West Los Angeles, CA (US)

( * ) Notice: Subject to any disclaimer, the term of this patent is extended or adjusted under 35 U.S.C. 154(b) by 0 days.

(21) Appl. No.: 13/844,721

(22) Filed: Mar. 15, 2013

(51) Int. Cl.
*G04B 37/00* (2006.01)
*G04B 37/14* (2006.01)
*G04B 45/00* (2006.01)

(52) U.S. Cl.
CPC ..... *G04B 37/0066* (2013.01); *G04B 37/1473* (2013.01); *G04B 45/0069* (2013.01)
USPC ..... 368/276; 368/316; D10/1; D10/27

(58) Field of Classification Search
CPC ..... G04B 37/00; G04B 37/0066; G04B 37/1473; G04B 37/22; G04B 45/00; G04B 45/0069; G04B 45/0076; G04B 47/04
USPC ..... 368/276, 285, 316, 317; D10/1, 27
See application file for complete search history.

(56) References Cited

U.S. PATENT DOCUMENTS

D85,027 S * 9/1931 Budlong ..... D10/27
2,814,927 A * 12/1957 Steimann ..... 368/317
3,220,176 A * 11/1965 Morgan et al. ..... 368/285
D218,186 S * 7/1970 Bergman ..... D10/27
3,889,806 A * 6/1975 Casella ..... 206/577
4,028,842 A * 6/1977 Adams ..... 206/301
D336,436 S * 6/1993 Kawashima et al. ..... D10/21
D337,530 S * 7/1993 Benton ..... D10/29
8,169,859 B1 5/2012 Sheehan

FOREIGN PATENT DOCUMENTS

DE 29616731 1/1997
EP 0854402 7/1998

OTHER PUBLICATIONS

UK Search Report for application No. GB1400383.4 (Feb. 24, 2014).

* cited by examiner

*Primary Examiner* — Vit W Miska
(74) *Attorney, Agent, or Firm* — Fulwider Patton LLP

(57) ABSTRACT

A clock case comprising a first plurality of upstanding, spaced-apart fins formed from flat sheets of material, each of the first plurality of fins having a plurality of slots extending vertically upward from a bottom edge; and, a second plurality of upstanding, spaced-apart fins formed from flat sheets of material, each of the second plurality of fins having a plurality of slots extending vertically downwards from a top edge. Each upwardly extending slot is configured to mate with a respective downwardly extending slot, whereby each of the first plurality of fins is interlocked with each of the second plurality of fins to form an orthogonal array of laterally extending fins and longitudinally extending fins.

7 Claims, 5 Drawing Sheets

CLOCK CASE

BACKGROUND

This application relates to a clock case and method for making and assembling same.

Clocks and timepieces are well known in the art. Traditional clocks and timepieces often are mounted in an attractive housing or case. For example, cases made from valuable hardwoods for placement on a mantelpiece in a home, or for a standing "grandfather" type clock, are well known.

However, problems exist relating to conventional wooden cases for clocks. In modern practice, consumers are turning ever more frequently to making purchases of goods such as fancy or decorative clocks "online," followed by shipping the goods in packages to their intended destination by regular mail or courier service. This new mode of commerce introduces a first problem, namely, that the goods must be efficiently packaged so as not too add too greatly to the size of the package, and hence the cost of the purchase. A second problem is that a method must be found to reduce the weight of the shipped package, without detracting too greatly from the quality and appearance of the finished product. A third problem is that high volumes of commercial sales are now having a destructive effect on the environment, in that sources of certain materials such as mahogany and other scarce hardwoods are becoming severely depleted, with corresponding destruction of rainforests and their natural habitats.

Thus, there is a need in the art of commercial manufacture and shipping of decorative wooden clock cases, for a design that is easy to make and ship, easy for the purchaser to assemble at home, and which does not severely impact the natural environment. The present invention addresses these and other needs.

SUMMARY OF THE INVENTION

The present invention is directed to a clock case which includes a first plurality of upstanding, spaced-apart fins formed from flat sheets of material, each of the first plurality of fins having a plurality of slots extending vertically upward from a bottom edge. The case further includes a second plurality of upstanding, spaced-apart fins formed from flat sheets of material, each of the second plurality of fins having a plurality of slots extending vertically downwards from a top edge. Each upwardly extending slot is configured to mate with a respective downwardly extending slot, whereby each of the first plurality of fins is interlocked with each of the second plurality of fins to form an orthogonal array of laterally extending fins and longitudinally extending fins. Furthermore, at least one laterally extending fin defines an opening sized to frame a clock face which is applied to a first surface of an adjacent laterally extending fin, whereby the clock face is substantially entirely visible through the opening. Furthermore, the case includes a motor and associated movement for driving clock hands across the clock face, the motor and movement being mounted on a second surface of the adjacent fin, the second surface being opposite the first surface. In some embodiments, the first plurality of fins each have identical outer profiles, and the second plurality of fins each have identical outer profiles. In some embodiments, the first and second plurality of fins are made from flat sheets of plywood. In preferred embodiments, the first plurality of fins are three in number, and the second plurality of fins are two in number.

The resulting structure provides a clock case that is a contemporary representation of a beautiful antique clock design of a type seldom seen today. The structure allows for easy assembly and disassembly and for flat packaging which permits the entire case to be stored and mailed in relatively low volume packaging. This makes the design more cost effective for transport and storage. Allowing the purchaser to assemble the clock case themselves after shipping gives the design a playful edge and allows the user to appreciate the simplicity of the design. Manufacturing the clock case out of plywood is not only a 'low toxicity' option but helps define what the design is trying to achieve, namely, a contemporary twist on antique clocks made of plywood (a man-made wood) as opposed to, say, a mahogany that would be an unsustainable material source. The case is very simple and cost effective to manufacture. The overall result is also very lightweight when compared with a traditional clock case which would take up a similar amount of space, because the design is achieved through the deception of appearing to have a larger mass by creating a three dimensional design through slotting pieces of wood together. Again this makes it a more sustainable option through 'light-weighting' than the latter.

These and other advantages will become apparent when read in conjunction with the drawings and the detailed description of the preferred embodiment.

DETAILED DESCRIPTION OF THE PREFERRED EMBODIMENTS

Figure 1:
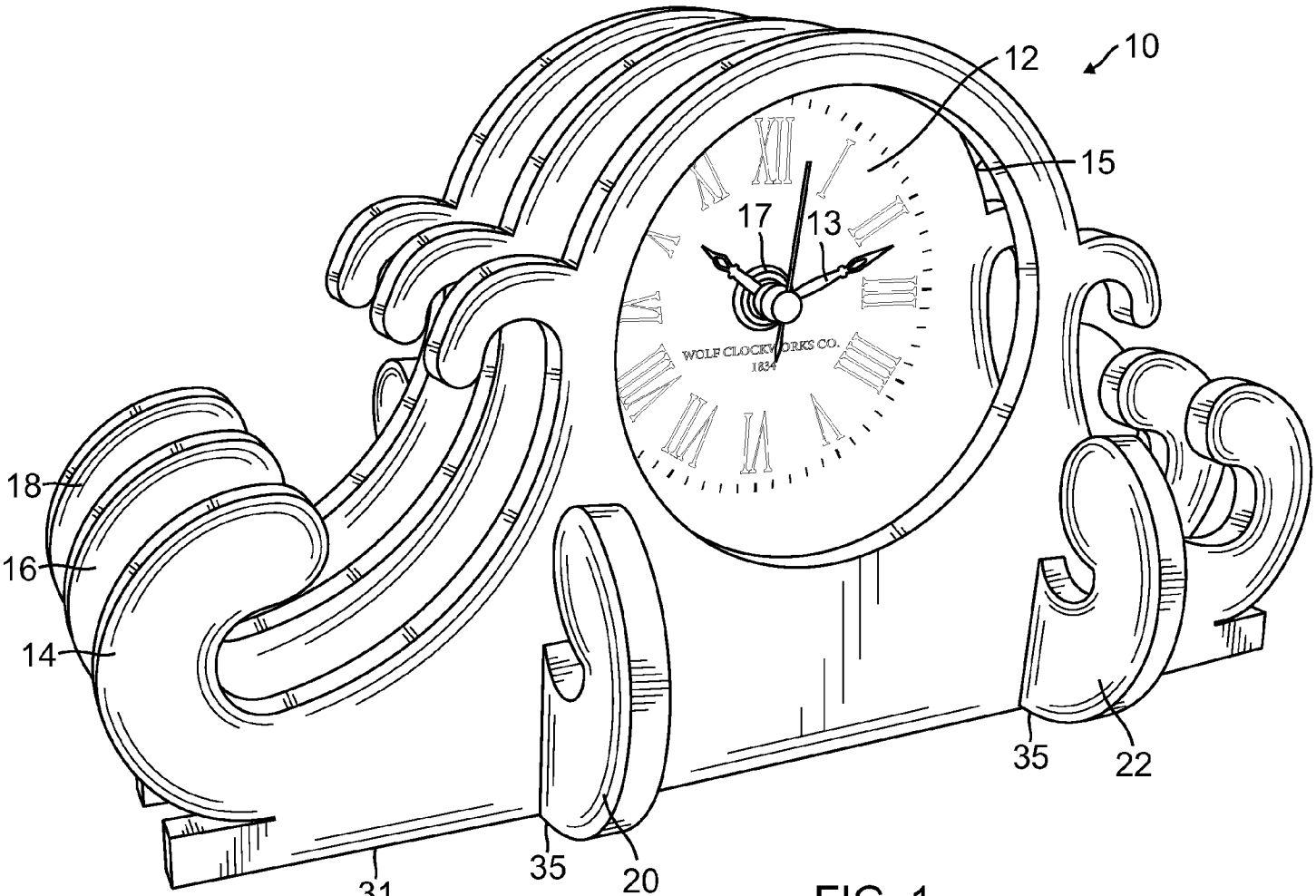
FIG. 1 is a front perspective view of an assembled clock case having features of the present invention.
Figure 2:
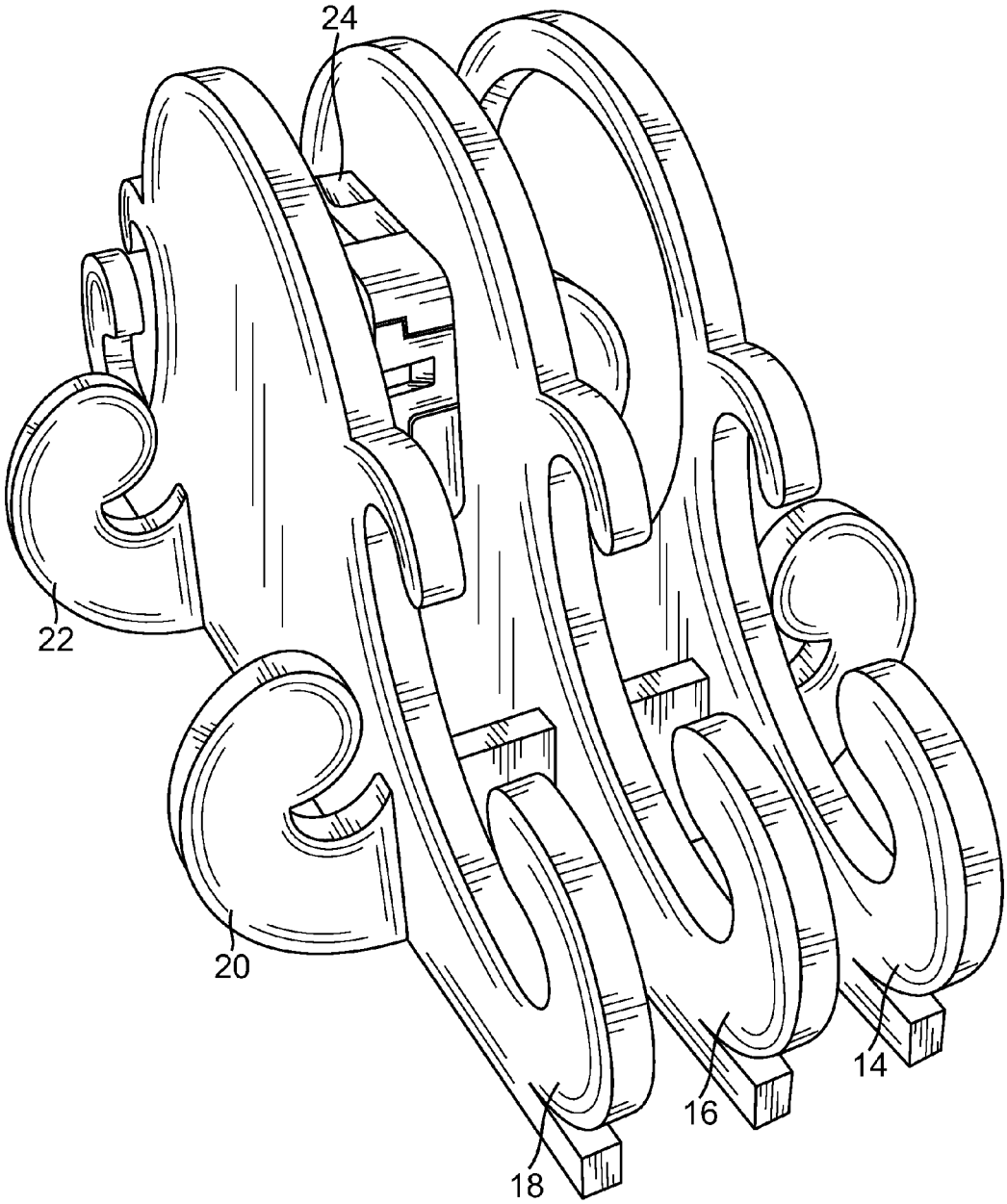
FIG. 2 is a rear perspective view of the clock of FIG. 1.
Figure 3:
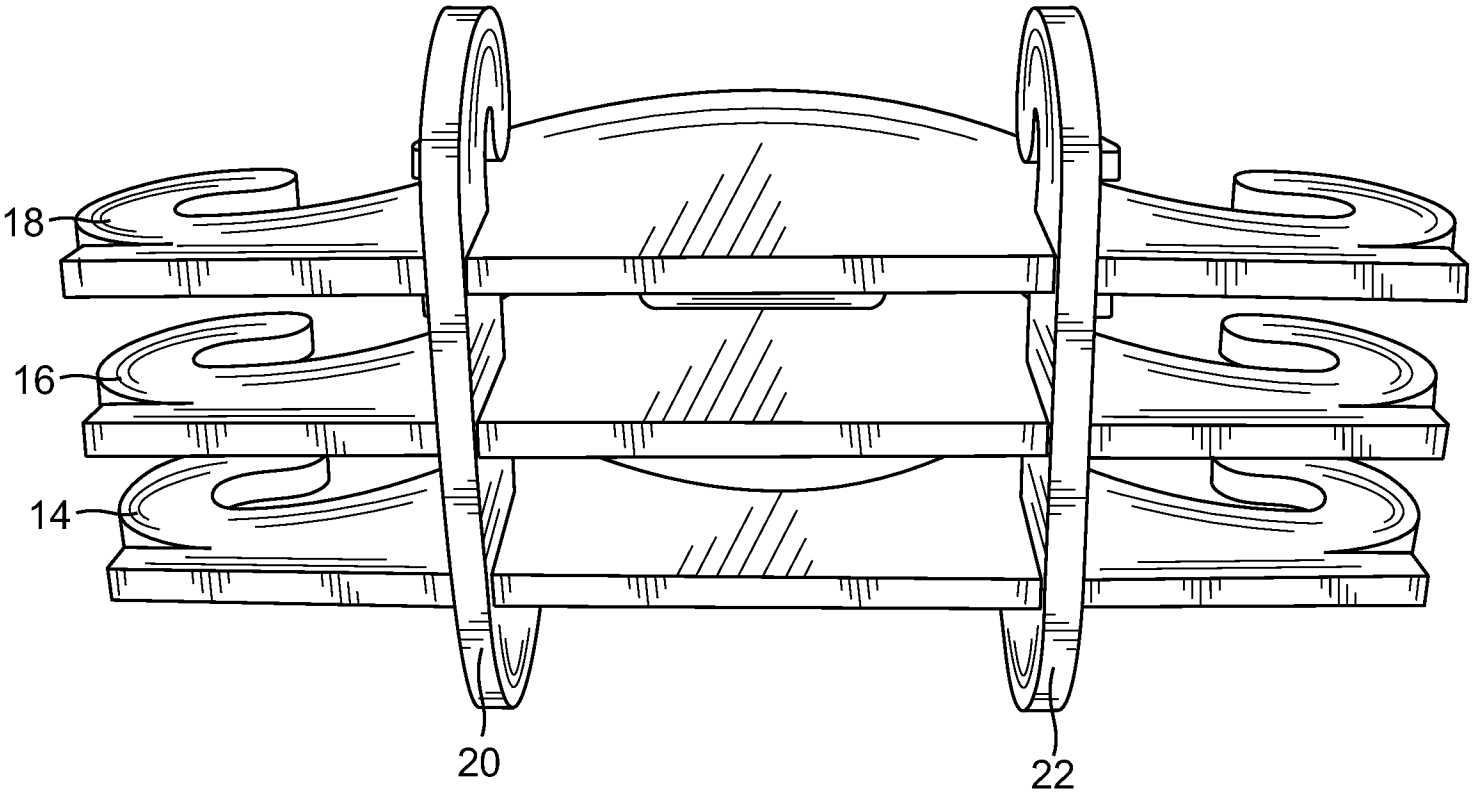
FIG. 3 is a bottom perspective view of the clock of FIG. 1.
Figure 4:
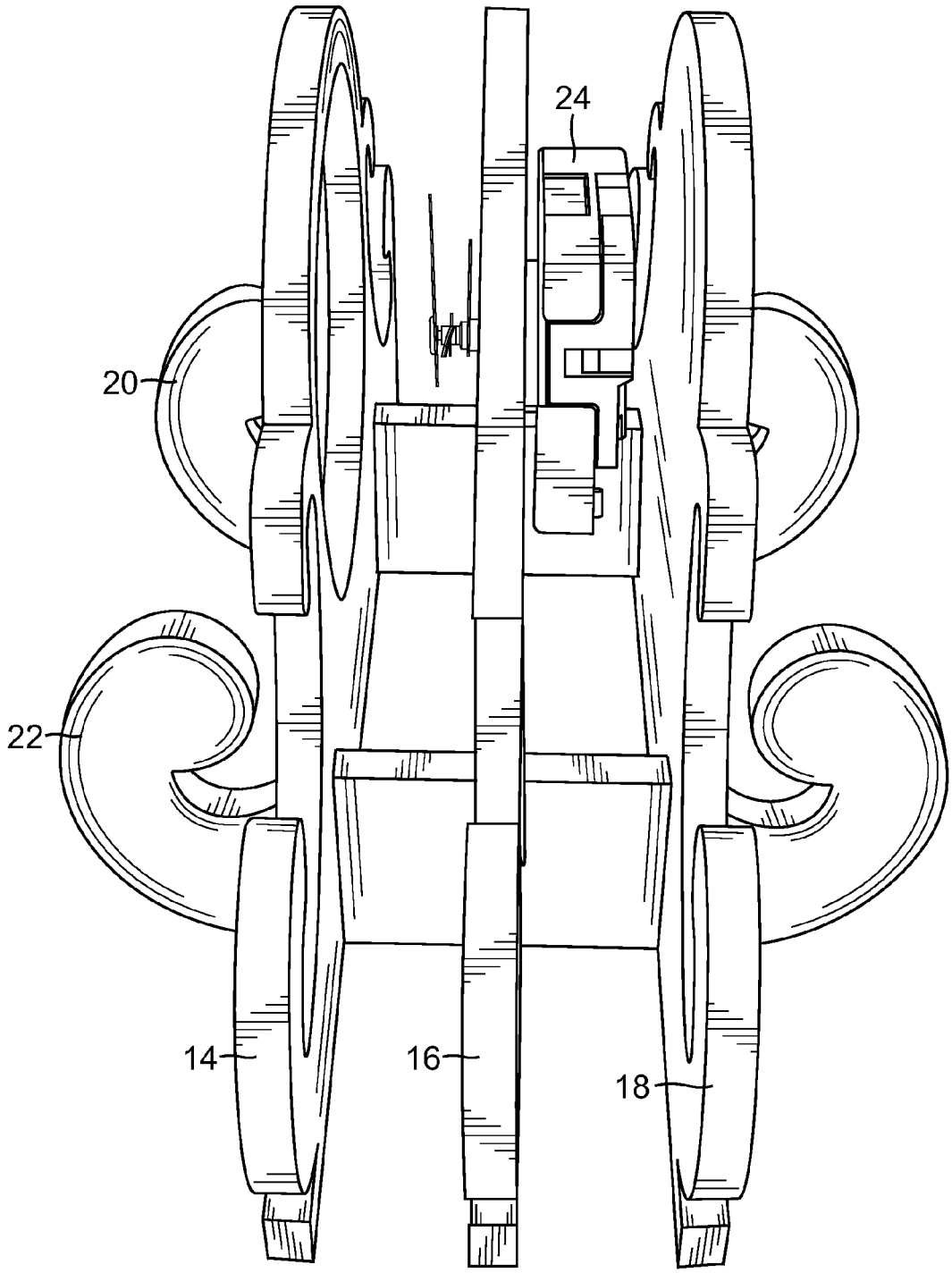
FIG. 4 is a side perspective view of the clock of FIG. 1.

In a preferred embodiment, the present invention comprises a case for a clock or timepiece, as exemplified in FIGS. 1-4 and generally identified by the numeral 10. The case 10, when assembled, comprises a plurality of upstanding, spaced-apart lateral fins, in the preferred embodiments three fins 14, 16, 18 that extend from left to right parallel to each other. Each lateral fin is cut from a flat sheet of wood, preferably plywood. The outer profile of each lateral fin is preferably identical to that of the other lateral fins.

The assembled case 10 further comprises a plurality of upstanding, spaced-apart longitudinal or transverse fins, preferably two fins 20, 22, that also are identical to each other. The lateral fins 14, 16, 18 each have a plurality of vertical slots 30 (equal in number to the number of longitudinal fins 20, 22), the vertical slots being located on a lower edge 31 of each lateral fin and extending vertically upwards from the edge. The longitudinal fins 20, 22 each have a plurality of vertical slots 32 (equal in number to the number of lateral fins), these vertical slots 32 being located on an upper edge 33 of each longitudinal fin and extending vertically downward from the edge. In a preferred embodiment, in which the outer profile of each fin is identical to that of a matching fin, an advantage is achieved in that an entire set of matching fins may be cut using only one jig-saw action, by placing set of wood sheets on top of each other when the pattern is cut.

When the case 10 is fully assembled, as seen in FIGS. 1-4, the slots on the two sets of fins are engaged with each other so that the lateral fins all stand parallel to each other, and the longitudinal fins stand parallel to each other. The slots are preferably designed to provide a series of cross lap joints that enable the two sets of fins to support each other, with each of the fins continuing beyond its respective cross lap joints. To this end, the slots are cut so that they exactly receive a mating slot and its surrounding material. If cutting tolerances are kept within an accurate range, the result is a frame structure of fins arranged in an intersecting perpendicular grid that has substantial resistance to movement out of the perpendicular. A small amount of glue suitable for woodwork may be applied at the slots 30, 32 to further enhance the secure engagement of the resulting grid, however glue may not be necessary for the proper functioning of the case 10. In a preferred embodiment, each of the slots 30 on a lateral fin 14, 16, 18 terminates short of the upper edge of the lateral fin, while each of the slots 32 on a longitudinal fin 20, 22 terminates short of the lower edge 35 of the longitudinal fin. The combined length of each pair of engaging slots is preferably equal to the height of the longitudinal fin at the location of the slot.

As shown in FIGS. 1-4, the fully assembled case preferably has an open top, open bottom, and open sides, with the bottom edges 31 of the lateral fins and the bottom edges 35 of the transverse fins together forming a base for standing the clock on a table or other surface.

With reference to FIG. 1, one of the lateral fins 14, in this case the frontmost lateral fin, is provided with a large preferably circular opening 15, sized to permit a person standing in front of the case 10 to look through the opening and see a clock face 12 applied to the front-facing surface of a more rearwardly disposed central lateral fin 16 being framed by the opening. The hands 13 of the clock are driven by a battery powered motor and clock mechanism or movement 24, that is positioned between the center fin 16 and the rearwardmost fin 18 and preferably mounted to the rearward facing surface of the center fin 16. In a preferred embodiment, the face 12 of the clock is painted onto, or adhered directly onto the center fin 16, and the clock mechanism is mounted through a small hole 17 formed in the center fin 16 at the center of the clock face 12. Alternatively, the clock face can be hung on a pin or nail (not shown) secured to the center of the center fin.

The resulting structure presents a person viewing the case with an elegant and playful structure having both depth and width. When viewed from the front (FIG. 1) the viewer may see the outline of a classical clock, which is repeated a plurality of times as the eye moves toward the rear of the case. The longitudinal fins 20, 22 are not particularly visible to the viewer from the front, but if the viewer moves to the side, an artistic theme that is present in the longitudinal fins may be seen repeated in the longitudinal fins.

Figure 5:
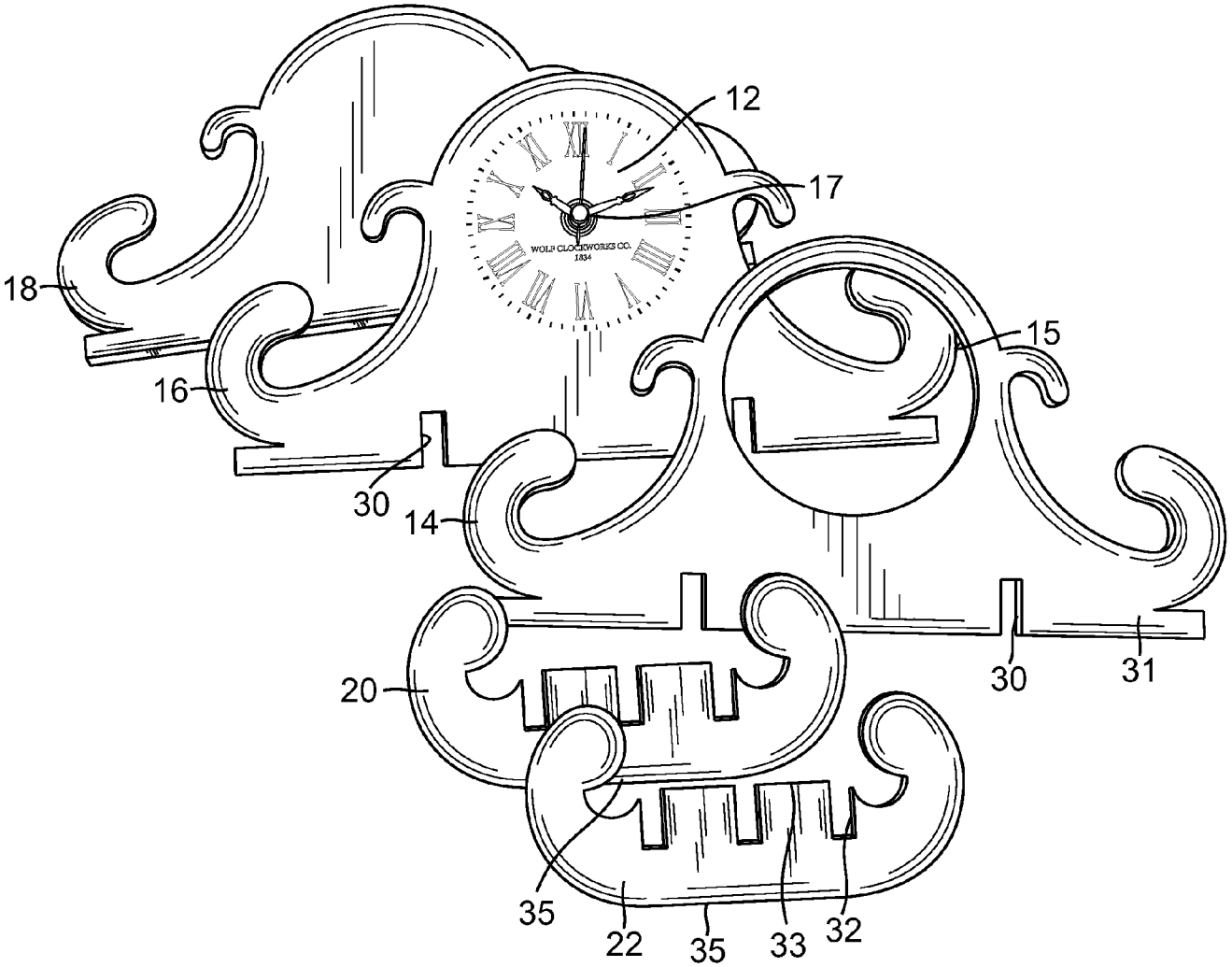
FIG. 5 is a view of the disassembled pieces of the clock of FIG. 1.

The present invention permits a manufacturer to package the case as a kit comprising a number of pre-cut flat sheets or panels, as seen in disassembled form in FIG. 5. Thus, although the assembled version of the case 10 has substantial depth and width, the manufacturer may ship the product to a purchaser in a package that is scarcely more than an inch or two thick. This reduction is size also has advantages for storing merchandise before sale and shipping. Furthermore, the purchaser will need no more than a few minutes to assemble the fins together, and attach the motor and movement 24 to arrive at the finished product.

In some embodiments, the fins are made from plywood. Although plywood may be considered a less desirable form of wood product than a hardwood like mahogany which is typically used for wooden clock cases, the reality of the situation today is that many consumers are becoming aware of the damage that extraction of hardwoods causes to the environment. Another advantage is the fact that plywood has a weight that is a fraction of the weight of a hardwood, and so the weight of the finished product is substantially reduced, along with the cost of shipping.

While the clock case depicted in FIG. 1 is in the shape of a classic mantle clock, it will be appreciated that the case of the present invention can be made in many different styles including a tall case or mini "grandfather" clock style, a cuckoo clock style, grand mantle clock style, a lady in the robe clock style, or even a station clock of the type used at rail stations, road junctions and squares in the British era. The style of the case is generally determined by the shape of the outer profile or perimeter of the fins which mimic the outline of a clock. For some clock styles, such as the station clock, it may be desirable to have clock faces visible on both sides of the case. In such instances, clock faces are applied to both the front-facing and rearward facing surfaces of the central fin, and both the frontmost and the rearwardmost fins are provided with large openings for framing the respective clock faces. Some clock styles also may be made with more or less than three lateral fins. For example, the grandfather clock style and the grand mantle clock style can be made with four lateral fins with the clock face applied to the third fin from the front and with large circular openings framing the clock face on the two frontmost lateral fins to give the illusion of greater depth. The cuckoo clock style can be made with only two lateral fins in which case the clock face is applied to the rearwardmost fin. For added structural support in the case of tall clock styles, an additional set of transverse fins with upwardly extending slots can be engaged with downwardly extending slots located on an upper edge of each lateral fin. The opening for framing a clock face preferably conforms to the shape of the shape of the corresponding clock face which can be round, square, or have other shapes depending on the style of clock being made. Surface ornamentation can be applied to one or more of the fins, if desired.

The present invention may, of course, be carried out in other specific ways than those herein set forth without departing from the essential characteristics of the invention. The present embodiments are, therefore, to be considered in all respects as illustrative and not restrictive, while the scope of the invention is set forth in the claims that follow.

I claim:

1. A clock case comprising;

a first plurality of upstanding, spaced-apart fins formed from flat sheets of material, each of the first plurality of fins having a plurality of slots extending vertically upward from a bottom edge;

a second plurality of upstanding, spaced-apart fins formed from flat sheets of material, each of the second plurality of fins having a plurality of slots extending vertically downwards from a top edge;

wherein each upwardly extending slot is configured to mate with a respective downwardly extending slot, whereby each of the first plurality of fins is interlocked with each of the second plurality of fins to form an orthogonal array of laterally extending fins and longitudinally extending fins;

and further wherein, one laterally extending fin defines an opening sized to frame a clock face which is applied to a first surface of an adjacent laterally extending fin, whereby the clock face is substantially entirely visible through the opening.

2. The case of claim 1, further including a motor for driving clock hands across the clock face, the motor being attached to a second surface of the adjacent fin, the second surface being opposite the first surface.

3. The case of claim 1, wherein the first plurality of fins each have identical outer profiles.

4. The case of claim 1, wherein the second plurality of fins each have identical outer profiles.

5. The case of claim 1, wherein the first and second plurality of fins are made from flat sheets of plywood.

6. The case of claim 1, wherein the first plurality of fins are three in number.

7. The case of claim 1, wherein the second plurality of fins are two in number.

* * * * *